US006708974B1

(12) United States Patent
Brown, III

(10) Patent No.: US 6,708,974 B1
(45) Date of Patent: Mar. 23, 2004

(54) POKER COMBINED WITH CRAPS

(75) Inventor: J. Breck Brown, III, Henderson, NV (US)

(73) Assignee: Steven R. Pyykkonen, Leonard, MI (US); part interest ( * ) Notice: Subject to any disclaimer, the term of this patent is extended or adjusted under 35 U.S.C. 154(b) by 0 days.

(21) Appl. No.: 10/264,481

(22) Filed: Oct. 3, 2002

(51) Int. Cl.[7] ..... A63F 1/00
(52) U.S. Cl. ..... 273/274; 273/292
(58) Field of Search ..... 273/274, 292, 273/243, 148 R, 309

(56) References Cited

U.S. PATENT DOCUMENTS 5,417,430 A 5/1995 Breeding ..... 273/292
5,669,606 A 9/1997 Brown ..... 273/274
5,695,192 A 12/1997 Brown ..... 273/274
5,758,878 A 6/1998 Brown ..... 273/274
5,782,472 A 7/1998 Brown ..... 273/274
5,842,698 A 12/1998 Brown ..... 273/292
5,863,041 A 1/1999 Boylan et al. ..... 273/292
5,961,119 A 10/1999 Brown ..... 273/292
6,019,373 A 2/2000 Brown ..... 273/274

*Primary Examiner*—William M. Pierce
(74) *Attorney, Agent, or Firm*—Howard & Howard

(57) ABSTRACT

The combination of a poker game and craps wherein a player may make a craps wager on one of three craps propositions in response to the first dealer down card being a spade. The second dealer down card is turned over and each player may place one last chance wager on at last chance payout odds. The last chance wagers are settled at the last chance payout odds after the third dealer down card is turned over. In the event the third dealer card is an Ace or two of spades, one of the players is randomly selected to roll the dice for anyone of three jackpots.

19 Claims, 3 Drawing Sheets

POKER COMBINED WITH CRAPS

BACKGROUND OF THE INVENTION

1. Field of the Invention

The subject invention relates to a combination of a card game and a dice game.

2. Description of the Prior Art

Various games are known in the prior art that combine standard playing cards and two dice. In fact, the inventor herein has patented various games combining the card games of twenty-one or blackjack or baccarat with the dice game of craps. Examples of such games are disclosed in U.S. Pat. Nos. 5,669,606; 5,695,192; 5,758,878; 5,782,472; 5,842,698; 5,961,119 and 6,019,373. Other games are disclosed in U.S. Pat. No. 5,417,430 to Breeding, U.S. Pat. No. 5,626,341 to Jones et al. and U.S. Pat. No. 5,863,041 to Boylan et al.

SUMMARY OF THE INVENTION

The subject invention provides a novel assembly and method wherein the playing of a poker game is combined with craps using two dice among a plurality of players and a dealer. The assembly performs and the method comprises the steps of; placing a first poker wager on behalf of each of a plurality of players, placing a craps progressive ante wager on behalf of each player, presenting at least two player down cards to each player, presenting at least first and second and third dealer down cards to the dealer, providing the opportunity to each player to increase the first poker wager, turning over the first dealer down card, establishing a first craps proposition based upon a first group of dice numbers at first odds, dividing and accumulating at least a portion of the craps progressive antes into a first jackpot for the first craps proposition, offering a craps wager opportunity to each player on the craps proposition in response to the first dealer down card being in a predetermined group of cards, providing a pair of dice each having six faces numbered one to six, selecting one of the players to roll the dice and rolling the dice by that player, settling the craps wager based upon the outcome of the roll of the dice and the odds at the craps proposition upon which the wagers were placed, turning over the second dealer down card, presenting various different last chance payout odds for various different poker hands, providing the opportunity to each player to place one last chance wager on at least one of the last chance payout odds, turning over the third dealer down card, and settling the last chance wagers at the last chance payout odds.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
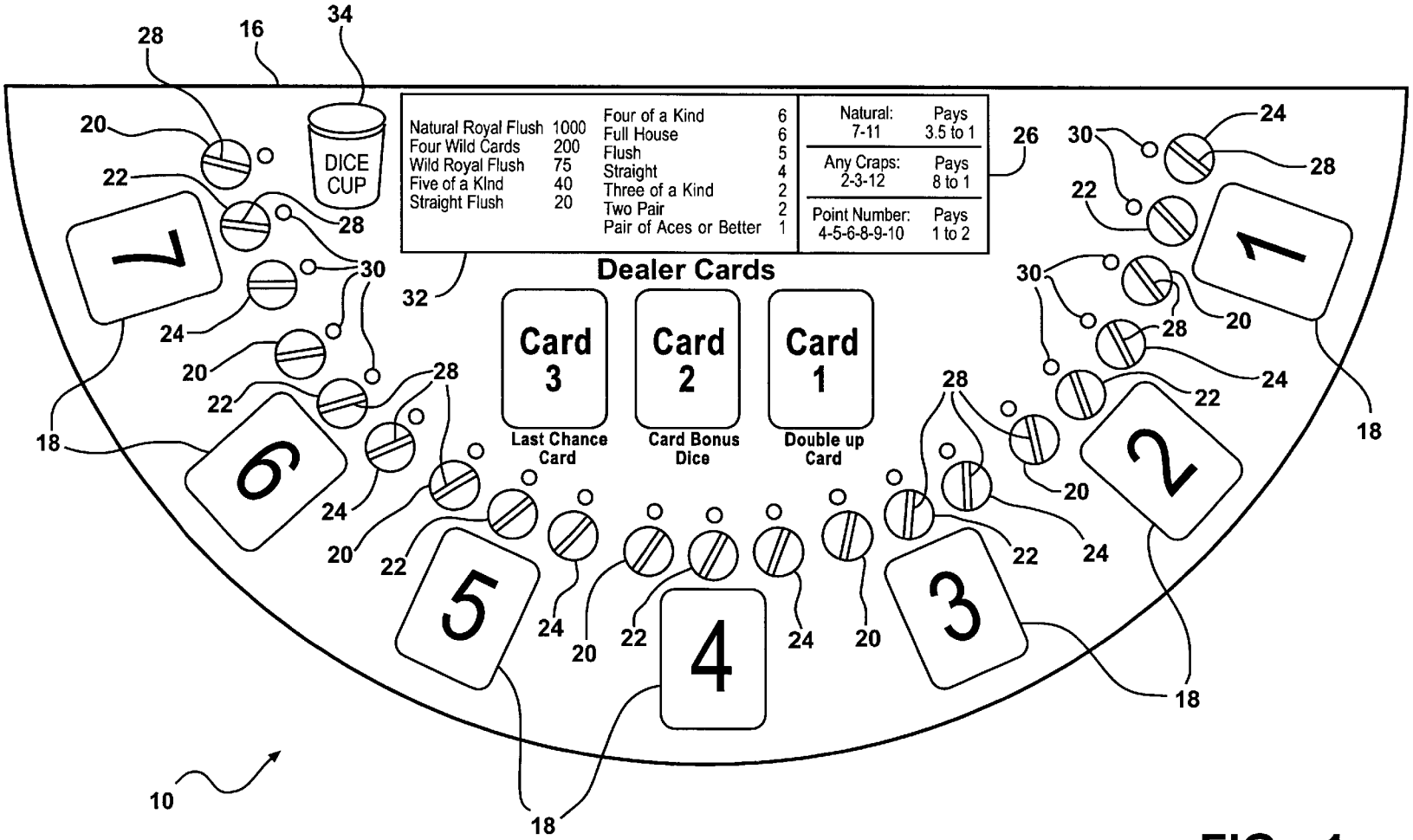
FIG. 1 is a game board or machine illustrating the subject invention.
Figure 3:
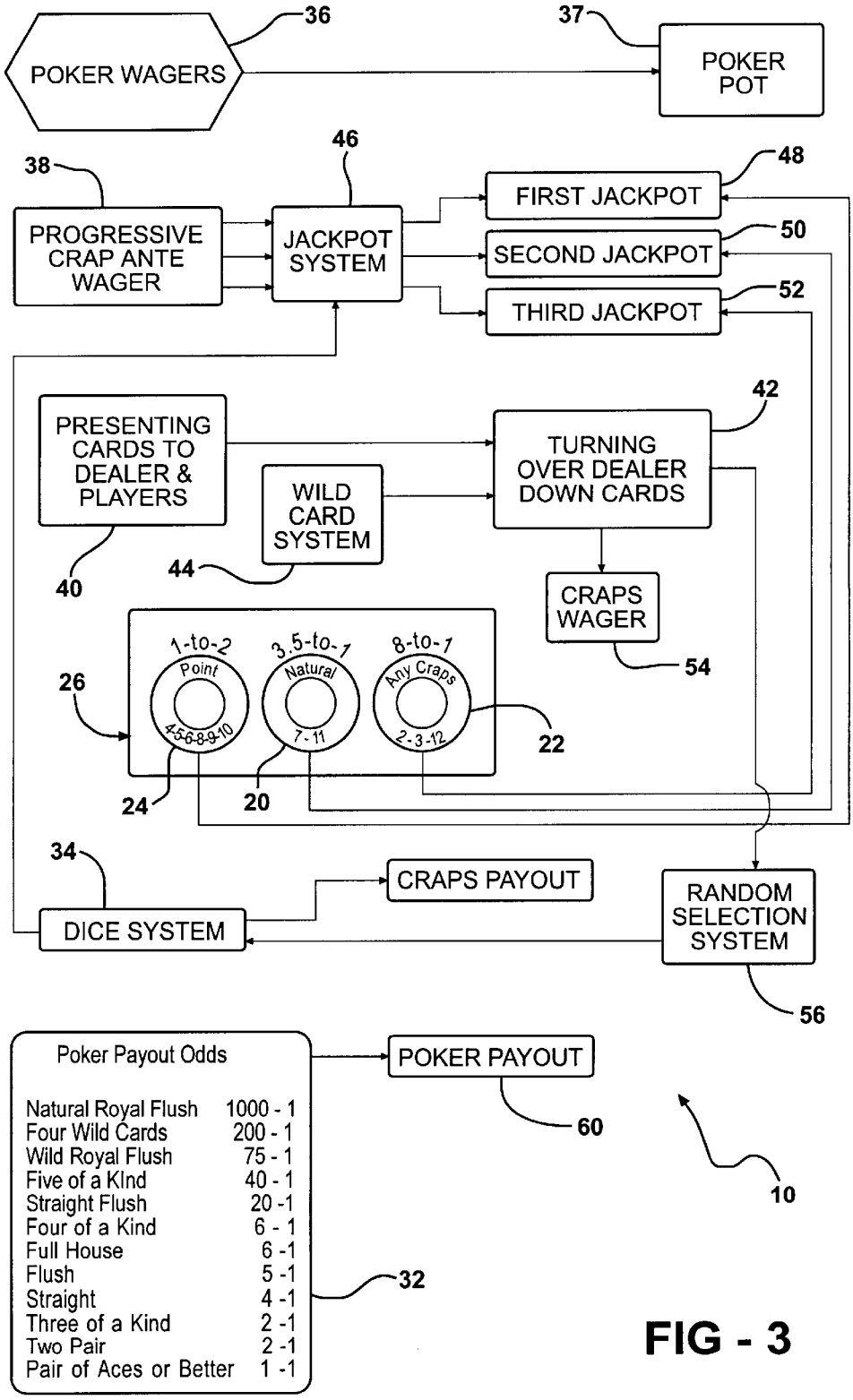
FIG. 3 is flow diagram of the subject invention.

Referring to the Figures, wherein like numerals indicate like or corresponding parts throughout the several views, an assembly for playing a poker game combined with craps using two dice among at least one of a plurality of players and a dealer is generally shown at 10 in FIGS. 1 and 3. The assembly takes the form of a mat, tablecloth or cover, or the like, or may even be implemented into a computer program producing images for a monitor.

The board 10 comprises an upper playing surface 12 that presents a semi-circular playing arena, defined by a semi-circle 14 and a straight diameter 16. A dealer presentation area is disposed within the semi-circle 14 for presenting the dealer cards.

The board also defines a plurality of player areas spaced about the circumference of the semi-circle 14 and opposed to the dealer playing area. Each of the player areas includes a rectangular card box 18 defining a player presentation area for each player to present the player cards. A plurality of craps wager indicator areas 20, 22 and 24 are disposed adjacent each player card rectangle 18 to divide the crap numbers two (2) through twelve (12) into a plurality of groups for wagering at different odds for each group. More specifically, a plurality of three craps wager indicators 20, 22 and 24 are presented for each player with each indicator presenting different odds for different total dice numbers. A first 20 of the indicators presents a first craps proposition based upon at least a first group of dice numbers seven (7) and eleven (11) at first odds of three and one half to one, while a second 22 of the indicators presents a second craps proposition based upon a second group of dice numbers two (2), three (3) and twelve (12) at second odds of eight to one, while a third indicator 24 presents a third craps proposition based upon a third group of the remaining dice numbers four (4), five (5), six (6), eight (8), nine (9) and ten (10) at third odds of one to two.

The game board 10 presents an odds area 26 indicating the first, second and third odds for the respective craps wager proposition areas 20, 22 and 24. That is, the craps payoff odds of three and one half chips for one chip bet on a natural dice number of seven (7) or eleven (11), the second craps payoff odds of eight chips for one chip bet on the dice numbers of two (2), three (3) and twelve (12), and the third craps payoff odds of one chip for each two chips bet on the remaining dice numbers four (4), five (5), six (6), eight (8), nine (9) and ten (10). Each wager indicator 20, 22 and 24 could have a slot 28 for receiving and electronically counting chips wagered with an indicator light 30 to indicate that a wager has been made.

The board 10 also presents a payout odds table 32 for presenting various different last chance payout odds for various different poker hands, as will become more clear hereinafter. An emblematic dice cup 34 is also shown to represent a dice system 34, either a manual cup and dice or an electronic, for providing a pair of dice each having six faces numbered one to six and for selecting one of the players to roll the dice and rolling the dice by that player.

The invention provides a method of playing a poker game combined with craps using two dice among a plurality of players and a dealer. The first step is the placing of a first poker wager on behalf of each of a plurality of players, i.e., an ante in order to play the game. This may be facilitated by a poker wager system 36 for placing a first poker wager on behalf of each player and for providing the opportunity to each player to increase the first poker wager at predetermined intervals in the game. These poker antes are placed in a poker pot 37, as is well known in the art. This system may be simply a player manually placing poker chips on the player's card rectangle 16 or may be accomplished electronically. A craps progressive ante wager is placed on behalf of each player, as by inserting chips into the slots 28. Accordingly, a progressive craps ante system 38 is included for placing a craps progressive ante wager on behalf of each player and keeping track of such wagers for each player.

The game proceeds by presenting at least two player down cards to each player and presenting at least first and second and third dealer down cards to the dealer, the player cards being disposed or presented in the respective rectangles 16 and the dealer cards being disposed or presented in the dealer card rectangles. A card presentation system 40 may be used for presenting the two player-down cards to each player and for presenting the first and second and third dealer down cards to the dealer. As alluded to above, this may be a display on a video machine.

This is followed by turning over the first dealer down card, which may be accomplished by a dealer card system 42 for turning over each of the dealer down cards. The first dealer downcard is designated as a wild card to be used with each player's cards, i.e., each player uses the first dealer downcard as a wild card in the player's hand. An electronic version of the game would include wild card system 44 for designating the first dealer down card as a wild card to be used with each player's cards. After the cards are dealt or presented with the first dealer downcard being face up, and after the players have the opportunity to look at their own cards, the opportunity is provided to each player to increase the first poker wager, i.e., by adding chips to the pile now on the players cards in the card rectangle 16 or through the poker wager system 36, as alluded to above. In the preferred steps of play, the first dealer downcard is a double up card allowing the player to double the initial wager. For example, if the player's initial wager was five dollars ($5), the player may increase that amount by ten dollars ($10), for a total wager of fifteen dollars ($15). However, each player has the option to stay without doubling up, in which case the player will be paid even money on the initial single wager, even if the player has a pair of Aces or better.

As alluded to above, a craps system 26 establishes and presents a first craps proposition 20 based upon a first group of dice numbers seven (7) and eleven (11) at first odds of three and one half to one, a second craps proposition 22 based upon a second group of dice numbers two (2), three (3) and twelve (12) at second odds of eight to one, and a third craps proposition 24 based upon a third group of the remaining dice numbers four (4), five (5), six (6), eight (8), nine (9) and ten (10) at third odds of one to two.

A jackpot system 46 is included for dividing and accumulating at least a portion of the craps progressive antes into a first jackpot 48 for the first craps proposition, dividing and accumulating at least a portion of the craps progressive antes into a second jackpot 50 for the second craps proposition, and dividing and accumulating at least a portion of the craps progressive antes into a third jackpot 52 for the third craps proposition.

The game progresses by offering a craps wager opportunity to each player on at least one of the craps propositions 20, 22, 24 in response to the first dealer down card being in a predetermined class of cards. This may be accomplished electronically with a craps wager system 54 for offering a craps wager opportunity to each player on one or more of the craps propositions 20, 22, 24 in response to the first dealer down card being in a predetermined group of cards. In the preferred form of play the predetermined group of cards are the spades or one suit of the cards. In response to such a predetermined card, the dealer presses or the system activates one or more of the three craps propositions 20, 22 or 24 at true odds. After the craps wagers are made, the dealer or the system activates a hold button to register the wagers and to initiate a random selection system 56 for randomly selecting one of the players to roll the dice and rolling the dice by that player. As set forth above, the player selected to roll the dice, is either manually or electronically provided a pair of dice 34 each having six faces numbered one to six.

A craps payout system 58 is included for settling the craps wager based upon the outcome of the roll of the dice and the odds at the craps proposition 20, 22, 24 upon which the wagers were placed.

Either the dealer or the dealer system 42 for turning over the dealer downcards, turns over second dealer down card. At this point each player will have seen four of the five cards and may be offered the opportunity to increase the wager on the poker hand. Accordingly, the player is presented the various different last chance payout odds 32 for various different poker hands, e.g., one thousand to one for a natural royal flush, or six to one for a full house. The poker wager system 36 may provide the opportunity to each player to place one last chance wager before the third dealer downcard is turned over, i.e., increase the poker hand wager. In either case, the dealer system 42, which may done be manually by a dealer or electronically, turns over the third dealer down card.

The wild card system 44 randomly selects a card value as a wild card value if matched by the third dealer downcard. In other words, if the third dealer downcard matches the wild card value in value not suit, the third dealer down card is wild for use in each player's hand. For example, if the randomly selected card value is a four, regardless of suit, any four appearing as the third dealer downcard is wild.

A poker payout system 60 is included for settling the last chance wagers at the last chance payout odds 32. If the player hand is lower than a pair of Aces, the player loses all of the wagers. Other wise the player will be paid even money on a single wager and at the last chance payout odds 32 on the double up wager. In other words, the player will be paid only even money on the initial poker wager even if the player's hand includes tow pair or better.

Figure 2:
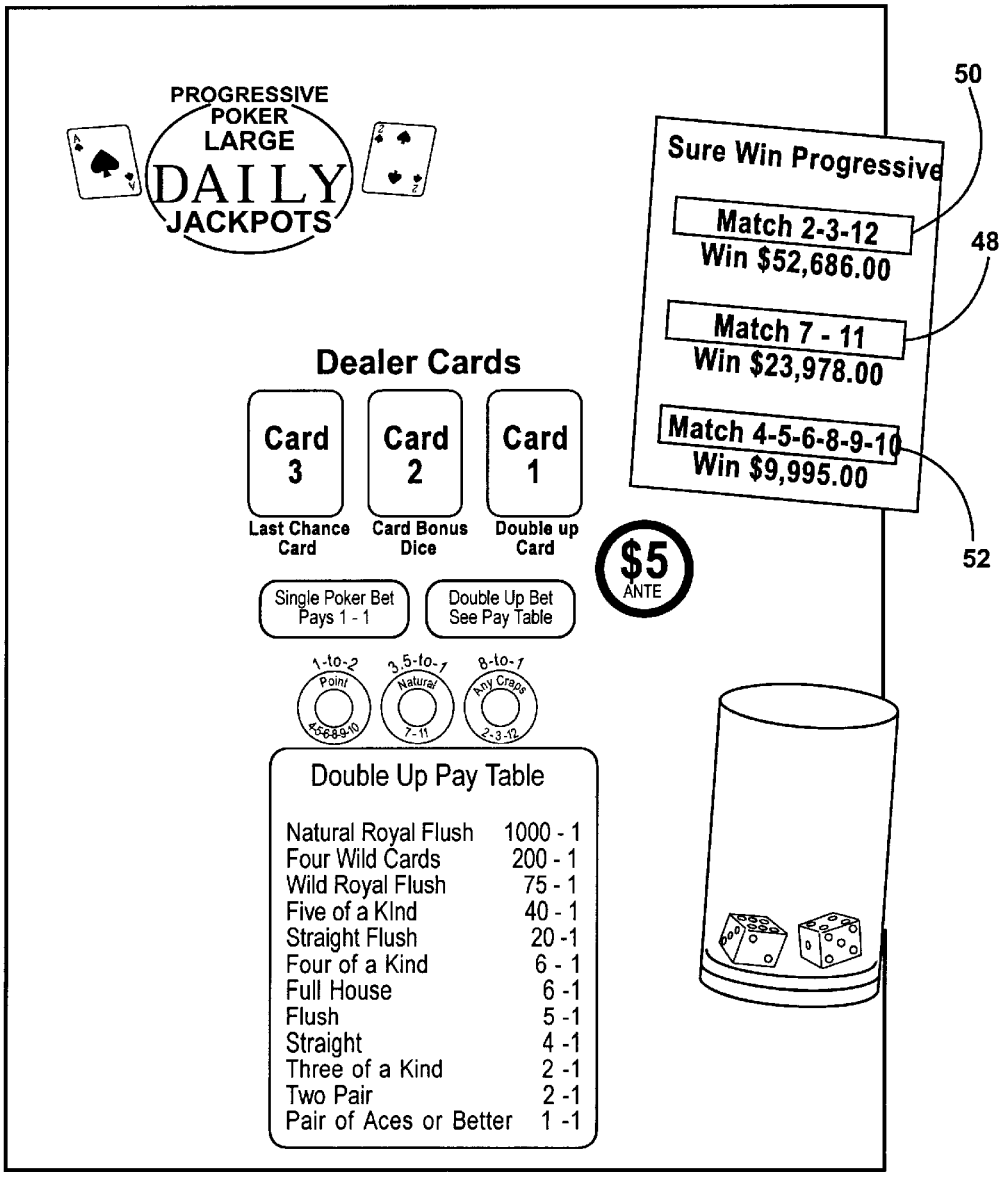
FIG. 2 is a board or machine presenting the subject invention.

However, an important aspect of the game is the added chance to roll the dice for a progressive craps pot in the event the third dealer down card is a predetermined card, e.g., the Ace or two of spades. The random selection system 56 randomly selecting one of the players to roll the dice for a jackpot and rolling the dice for a jackpot by that player in response to at least one of the dealer down cards being a predetermined card, e.g., the Ace or two of spades. This allows the selected player to roll the dice by the dice system 34 to match one of the three progressive jackpots 48, 50, 52, the running or accumulated amounts being shown by a sign as illustrated in FIG. 2. The craps payout system 58 pays out to the player rolling the dice for a jackpot a major portion of the jackpot for the craps proposition having the number matched by the roll of the dice for the jackpot. However, all players in the round would receive a share of the matched jackpot. For example, any craps number in the third proposition 24 pays eight five percent to the player selected to roll the dice and fifteen percent would be divided among the other players. A match to a natural in the first proposition 20 would pay seventy five percent to the player rolling the dice and twenty five percent to the remaining players. The point numbers in the second craps proposition 22 would pay sixty percent to the player rolling the dice and forty percent to the remaining players. The jackpot system 46 is responsive to the dice system 34 for paying out to the player rolling the dice for a jackpot a major portion of the jackpot for the craps proposition having the number matched by the roll of the dice for the jackpot. Likewise, the jackpot system 46 is responsive to the dice system 34 for paying out to the remaining players a minor portion of the jackpot for the craps proposition having the number matched by the roll of the dice for the jackpot.

Initially, twenty percent of the craps wagers is directed by the jackpot system 46 to each of the first, second and third jackpots 48, 50 and 52. Five percent of the craps wagers is reserved to re-seed each of the jackpots after a player wins a jackpot. This leaves twenty five percent that goes to the proprietor.

Obviously, many modifications and variations of the present invention are possible in light of the above teachings. The invention may be practiced otherwise than as specifically described within the scope of the appended claims.

What is claimed is:

1. A method of playing a poker game combined with craps using two dice among a plurality of players and a dealer, said method comprising the steps of;

placing a first poker wager on behalf of each of a plurality of players, placing a craps progressive ante wager on behalf of each player, presenting at least two player down cards to each player, presenting at least first and second and third dealer down cards to the dealer, turning over the first dealer down card, providing the opportunity to each player to increase the first poker wager, establishing a first craps proposition based upon a first group of dice numbers at first odds, dividing and accumulating at least a portion of the craps progressive antes into a first jackpot for the first craps proposition, offering a craps wager opportunity to each player on the craps proposition in response to the first dealer down card being in a predetermined group of cards, providing a pair of dice each having six faces numbered one to six, selecting one of the players to roll the dice and rolling the dice by that player, settling the craps wager based upon the outcome of the roll of the dice and the odds at the craps proposition upon which the wagers were placed, turning over the second dealer down card, presenting various different last chance payout odds for various different poker hands, turning over the third dealer down card, and settling the last chance wagers at the last chance payout odds.

2. A method as set forth in claim 1 including randomly selecting one of the players to roll the dice for a jackpot and rolling the dice for a jackpot by that player in response to at least one of the dealer down cards being a predetermined card.

3. A method as set forth in claim 2 including paying out to the player rolling the dice for a jackpot a major portion of the jackpot for the craps proposition having the number matched by the roll of the dice for the jackpot.

4. A method as set forth in claim 3 including paying out to the remaining players a minor portion of the jackpot for the craps proposition having the number matched by the roll of the dice for the jackpot.

5. A method as set forth in claim 3 including establishing the first craps proposition based upon the first group of dice numbers being seven and eleven (7 and 11) at the first odds of three and one half to one, establishing a second craps proposition based upon a second group of dice numbers two, three and twelve (2, 3 and 12) at second odds of eight to one, and establishing a third craps proposition based upon a third group of dice numbers four, five, six, eight, nine and ten (4, 5, 6, 8, 9 and 10) at third odds of one to two.

6. A method as set forth in claim 5 including dividing and accumulating at least a portion of the craps progressive antes into a second jackpot for the second craps proposition, and dividing and accumulating at least a portion of the craps progressive antes into a third jackpot for the third craps proposition.

7. A method as set forth in claim 1 including designating the first dealer down card as a wild card with each player's cards.

8. A method as set forth in claim 1 including randomly selecting a card value as a wild card value if matched by the third dealer downcard.

9. A method as set forth in claim 1 including providing the opportunity to each player to place one last chance wager on at least one of the last chance payout odds before turning over the third dealer downcard.

10. A method of playing a poker game combined with craps using two dice among a plurality of players and a dealer, said method comprising the steps of;

placing a first poker wager on behalf of each of a plurality of players, placing a craps progressive ante wager on behalf of each player, presenting at least two player down cards to each player, presenting at least first and second and third dealer down cards to the dealer, turning over the first dealer down card as a wild card with each player's cards, providing the opportunity to each player to increase the first poker wager, establishing a first craps proposition based upon a first group of dice numbers seven (7) and eleven (11) at first odds of three and one half to one, establishing a second craps proposition based upon a second group of dice numbers two, three and twelve (2, 3 and 12) at second odds of eight to one, establishing a third craps proposition based upon a third group of dice numbers four, five, six, eight, nine and ten (4, 5, 6, 8, 9 and 10) at third odds of one to two, dividing and accumulating at least a portion of the craps progressive antes into a first jackpot for the first craps proposition, dividing and accumulating at least a portion of the craps progressive antes into a second jackpot for the second craps proposition, dividing and accumulating at least a portion of the craps progressive antes into a third jackpot for the third craps proposition, offering a craps wager opportunity to each player on at least one of the craps propositions in response to the first dealer down card being in a predetermined class of cards, providing a pair of dice each having six faces numbered one to six, randomly selecting one of the players to roll the dice and rolling the dice by that player, settling the craps wager based upon the outcome of the roll of the dice and the odds at the respective propositions upon which the wagers were placed, turning over the second dealer down card, presenting various different last chance payout odds for various different poker hands, turning over the third dealer down card, randomly selecting a card value as a wild card value if matched by the third dealer downcard, settling the last chance wagers at the last chance payout odds, randomly selecting one of the players to roll the dice for a jackpot and rolling the dice for a jackpot by that player in response to at least one of the dealer down cards being a predetermined card, paying out to the player rolling the dice for a jackpot a major portion of the jackpot for the craps proposition having the number matched by the roll of the dice for the jackpot, and paying out to the remaining players a minor portion of the jackpot for the craps proposition having the number matched by the roll of the dice for the jackpot.

11. An assembly for playing a poker game combined with craps using two dice among at least one of a plurality of players and a dealer, said assembly comprising;

a poker wager system for placing a first poker wager on behalf of the of player and for providing the opportunity to the player to increase the first poker wager at predetermined intervals in the game, a progressive craps ante system for placing a craps progressive ante wager on behalf of the player, a card presentation system for presenting at least two player down cards to each player and for presenting at least first and second and third dealer down cards to the dealer, a dealer card system for turning over the dealer down cards, a craps system for establishing a first craps proposition based upon at least a first group of dice numbers at first odds, a jackpot system for dividing and accumulating at least a portion of the craps progressive antes into a first jackpot for the first craps proposition, a craps wager system for offering a craps wager opportunity to each player on the craps proposition in response to the first dealer down card being in a predetermined group of cards, a dice system for providing a pair of dice each having six faces numbered one to six and for selecting one of the players to roll the dice and rolling the dice by that player, a craps payout system for settling the craps wager based upon the outcome of the roll of the dice and the odds at the craps proposition upon which the wagers were placed, a payout odds system for presenting various different last chance payout odds for various different poker hands, a poker payout system for settling the last chance wagers at said last chance payout odds.

12. An assembly as set forth in claim 10 including a random selection system for randomly selecting one of the players to roll the dice for a jackpot in response to at least one of the dealer down cards being a predetermined card.

13. An assembly as set forth in claim 11 wherein said jackpot system is responsive to said dice system for paying out to the player rolling the dice for a jackpot a major portion of the jackpot for the craps proposition having the number matched by the roll of the dice for the jackpot.

14. An assembly as set forth in claim 12 wherein said jackpot system is responsive to said dice system for paying out to the remaining players a minor portion of the jackpot for the craps proposition having the number matched by the roll of the dice for the jackpot.

15. An assembly as set forth in claim 12 wherein said craps system establishes the first craps proposition based upon the first group of dice numbers being seven and eleven (7 and 11) at the first odds of three and one half to one, and a second craps proposition based upon a second group of dice numbers two, three and twelve (2, 3 and 12) at second odds of eight to one, and a third craps proposition based upon a third group of dice numbers four, five, six, eight, nine and ten (4, 5, 6, 8, 9 and 10) at third odds of one to two.

16. An assembly as set forth in claim 14 wherein said jackpot system divides and accumulates at least a portion of the craps progressive antes into a second jackpot for the second craps proposition and at least a portion of the craps progressive antes into a third jackpot for the third craps proposition.

17. An assembly as set forth in claim 10 including a wild card system for designating the first dealer down card as a wild card with each player's cards.

18. An assembly as set forth in claim 10 including a wild card system for randomly selecting a card value as a wild card value if matched by the third dealer downcard.

19. An assembly for playing a poker game combined with craps using two dice among a plurality of players and a dealer, said assembly comprising; a plurality of systems for placing a first poker wager on behalf of each of a plurality of players, placing a craps progressive ante wager on behalf of each player, presenting at least two player down cards to each player, presenting at least first and second and third dealer down cards to the dealer, turning over the first dealer down card as a wild card with each player's cards, providing the opportunity to each player to increase the first poker wager, establishing a first craps proposition based upon a first group of dice numbers seven and eleven (7 and 11) at first odds of three and one half to one, establishing a second craps proposition based upon a second group of dice numbers two, three and twelve (2, 3 and 12) at second odds of eight to one, establishing a third craps proposition based upon a third group of dice numbers four, five, six, eight, nine and ten (4, 5, 6, 8, 9 and 10) at third odds of one to two, dividing and accumulating at least a portion of the craps progressive antes into a first jackpot for the first craps proposition, dividing and accumulating at least a portion of the craps progressive antes into a second jackpot for the second craps proposition, dividing and accumulating at least a portion of the craps progressive antes into a third jackpot for the third craps proposition, offering a craps wager opportunity to each player on at least one of the craps propositions in response to the first dealer down card being in a predetermined class of cards, providing a pair of dice each having six faces numbered one to six, randomly selecting one of the players to roll the dice and rolling the dice by that player, settling the craps wager based upon the outcome of the roll of the dice and the odds at the respective propositions upon which the wagers were placed, turning over the second dealer down card, presenting various different last chance payout odds for various different poker hands, turning over the third dealer down card, randomly selecting a card value as a wild card value if matched by said third dealer downcard, settling the last chance wagers at said last chance payout odds, randomly selecting one of the players to roll the dice for a jackpot and rolling the dice for a jackpot by that player in response to at least one of the dealer down cards being a predetermined card, paying out to the player rolling the dice for a jackpot a major portion of the jackpot for the craps proposition having the number matched by the roll of the dice for the jackpot, and paying out to the remaining players a minor portion of the jackpot for the craps proposition having the number matched by the roll of the dice for the jackpot.

* * * * *